US005140900A

United States Patent [19]

Burch

[11] Patent Number: 5,140,900

[45] Date of Patent: Aug. 25, 1992

[54] INK DISTRIBUTION ASSEMBLY

[75] Inventor: Laymon L. Burch, Phoenix, Ariz.

[73] Assignee: B. Bunch Company, Inc., Phoenix, Ariz.

[21] Appl. No.: 719,988

[22] Filed: Jun. 24, 1991

[51] Int. Cl.[5] ..... B41F 31/06; B41F 31/14; B41L 27/16

[52] U.S. Cl. ..... 101/350

[58] Field of Search ..... 101/350, 363, 349, 207, 101/208, 209, 210, 148, DIG. 32; 118/259, 261, 258

[56] References Cited

U.S. PATENT DOCUMENTS 4,524,692 6/1985 Rodvelt ..... 101/DIG. 32
4,559,874 12/1985 Schuhmann ..... 101/350
4,688,482 8/1987 Tobias ..... 101/350

*Primary Examiner*—J. Reed Fisher
*Attorney, Agent, or Firm*—Tod R. Nissle

[57] ABSTRACT

An ink distribution assembly of the type including a fountain roller, an ink fountain for distributing ink on the surface of the fountain roller, a distributor roller, and a ductor roller for transferring ink from the fountain roller to the distributor roller. When the speed of rotation of the fountain roller and distributor roller varies, the ink distribution assembly requires less adjustment of the flow rate of ink from the ink fountain than do conventional ink distribution assemblies which utilize a ductor roller than oscillates through an arc between the fountain roller and the distributor roller.

14 Claims, 2 Drawing Sheets

INK DISTRIBUTION ASSEMBLY

This invention pertains to ink distribution assemblies for printing equipment.

More particularly, the invention pertains to an ink distribution assembly of the type including a fountain roller, an ink fountain for distributing ink on the surface of the fountain roller, a distributor roller, and a ductor roller for transferring ink from the fountain roller to the distributor roller.

In a further respect, the invention relates to an ink distribution assembly of the type described which, when the speed of rotation of the fountain roller and distributor roller vary, requires less adjustment of the flow rate of ink from the ink fountain than do conventional ink distribution assemblies which utilize a ductor roller which oscillates through an arc between the fountain roller and the distributor roller.

Ink distribution assemblies for printing apparatus are well known in the art and ordinarily include a fountain roller, an ink fountain for distributing a layer of ink on the cylindrical outer surface of the fountain roller, a distributor roller, and a ductor roller. The fountain includes a fixed sloped flat plate or blade having a lower edge parallel to and adjacent the outer cylindrical surface of the fountain roller. A reservoir of ink is stored above the blade. At least a portion of one side of the reservoir of ink rests against, directly contacts, and is contained by the fountain roller. As the fountain roller turns, the outer cylindrical surface of the fountain roller pulls ink between the outer cylindrical surface of the fountain roller and the lower edge of the fountain blade to form a relatively uniform thin layer of ink on the fountain roller. The ductor roller is pivotally mounted on an arm which is oscillated by a cam through an arc between the fountain roller and the distributor roller. The ductor roller is mounted on the arm for rotation about the longitudinal axis of the ductor roller. The ductor roller is not driven and free-wheels on the arm. Forces generated on the ductor roller by the fountain roller and distributor roller when the ductor roller contacts the same cause the ductor roller to rotate. When the ductor roller is in position against the fountain roller the outer cylindrical surface of the ductor roller collects ink from the fountain roller. When the ductor roller oscillates against the distributor roller, the ductor roller distributes ink on the outer cylindrical surface of the distributor roller. A disadvantage of the foregoing conventional ink distribution assembly is that when the speed of the fountain roller and distributor roller is increased, the settings on the ink fountain may have to be increased to dispense more ink. The flow of ink has to be increased due, at least in part, to "cam slap". Cam slap occurs when the cam follower skids over or slaps when it comes off of the high point of the cam. Cam slap causes variance in the amount of time that the ductor roller contacts the fountain roller and distributor roller.

Accordingly, it would be highly desirable to provide an improved ink distribution assembly which, during an increase in the speed of operation of the assembly, maintained a more consistent and uniform transfer of ink from the fountain roller to the distributor roller.

Therefore, it is a principal object of the invention to provide an improved ink distribution assembly Another object of the invention is to provide an improved ink distribution assembly of the type including a fountain roller, an ink fountain for distributing ink onto the fountain roller, a distributor roller, and a ductor roller for transferring ink from the fountain roller to the distributor roller.

A further object of the invention is to provide an improved ink distribution assembly of the type described which, as the speed of rotation of the fountain roller and the distributor roller increases, uniformly increases in proportion to the increase in the speed of rotation of the fountain roller and distributor roller the quantity of ink transferred from the fountain roller to the distributor roller during a given time period.

These and other, further and more specific objects and advantages of the invention will be apparent to those skilled in the art from the following detailed description thereof, taken in conjunction with the drawings, in which.

Briefly, in accordance with my invention, I provide an improved ink distribution assembly for printing apparatus. The ink distribution assembly includes a fountain roller; fountain means for storing a quantity of ink and distributing the ink on the fountain roller; a ductor roller parallel to and at a fixed distance from the fountain roller and having a cylindrical outer surface spaced apart from the fountain roller and including a longitudinal resilient strip upraised from the cylindrical surface, the strip contacting the fountain roller during each rotation of the ductor roller to transfer ink from the fountain roller to the strip; a distributor roller parallel to and at a fixed distance from the cylindrical outer surface of the ductor roller, the strip contacting the distributor roller during each rotation of the ductor roller to transfer ink from the strip to the distributor roller; at least one downstream roller parallel to and operatively associated with the distributor roller to carry ink from the distributor roller to a selected roller station in the printing apparatus; and, means for rotating the fountain roller, the ductor roller, and the distributor roller.

Figure 1:
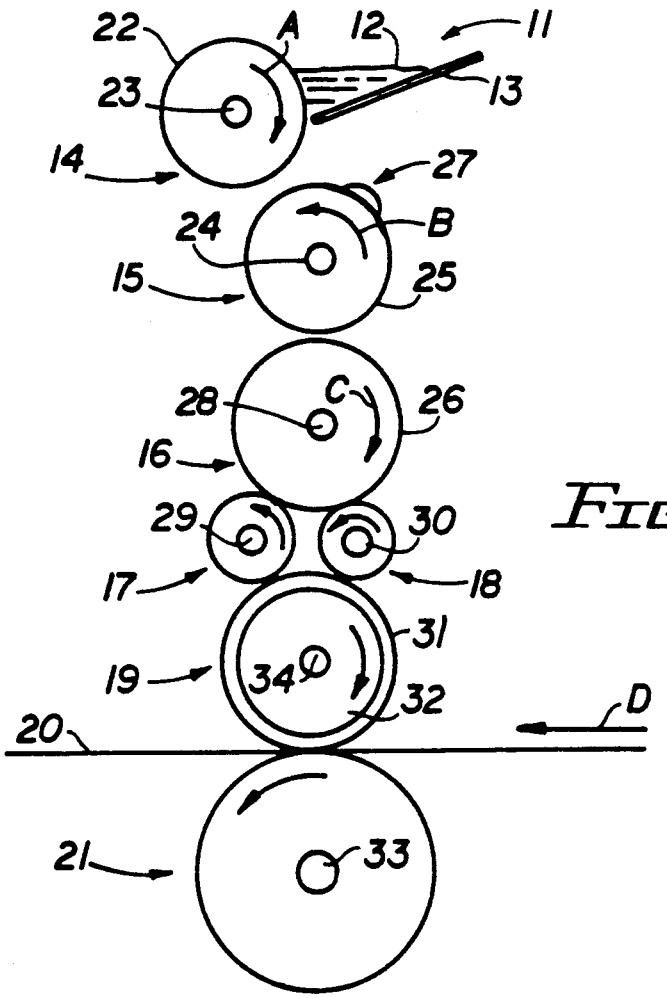
FIG. 1 is a side elevation schematic view illustrating an ink distribution assembly constructed in accordance with the principles of the invention.

Turning now to the drawings, which depict the presently preferred embodiments of the invention for the purpose of illustrating the practice thereof and not by way of limitation of the scope of the invention, and in which like reference characters refer to corresponding elements throughout the several views, FIG. 1 illustrates an ink distribution assembly constructed in accordance with the principles of the invention and including fountain means 11, fountain roller 14, ductor roller 15, distributor roller 16, form rollers 17 and 18, plate or imprinting roller 19, and support roller 21. Fountain means includes a plate or blade 13 which supports in part a reservoir 12 of ink. The lower edge of blade 13 is adjacent the smooth outer cylindrical surface of fountain roller 14. Roller 14 draws ink 12 along its surface 22 intermediate the lower edge of blade 13. Roller 14 is fixedly attached to and rotates simultaneously with shaft 23.

Ductor roller 15 is fixedly attached to and simultaneously rotates with shaft 24. The outer cylindrical surface 25 of ductor roller 15 is spaced apart from surface 22 of roller 14 and from the outer smooth cylindrical surface 26 of distributor roller 16. Resilient longitudinal strip 27 extends the length of ductor roller 15 and is parallel to the longitudinal axis of roller 15 and to elongate shaft 24. Strip 27 extends outwardly from surface 25 a distance sufficient for strip 27 to bridge the gap between rollers 14, 15 at their closest approach and for strip 27 to "kiss" surface 22 to remove ink from surface 22 onto strip 27. The distance between rollers 15 and 16 at their point of closest approach is about equal to the distance between rollers 14 and 15 at their closest approach such that strip 27 can bridge the gap between rollers 15, 16 and apply ink to surface 26 of the distributor roller 16. Roller 16 is fixedly attached to and rotates simultaneously with elongate cylindrical shaft 28.

Form rollers 17 and 18 are fixedly attached to and rotate simultaneously with shafts 29 and 30, respectively. Imprinting roller 19 includes plate 19 or other printing means on the circumference of a cylindrical roller 32. Plate 31 typically includes upraised portions which receive ink from the outer smooth cylindrical surfaces of form rollers 17 and 18 and apply the ink to the strip 20 made from paper or other desired materials. Strip 20 is drawn between imprint roller 19 and support roller 21.

Points on the surfaces of form roller 17 and 18 typically move at the same velocity as points on the outer cylindrical surface of distributor roller 26 and as points on the outer surface of cylindrical plate 31. Points on the outer surface of plate 31 move at about the same velocity as points on the outer smooth cylindrical surface of support roller 21. Support roller 21 is fixedly attached to and rotates simultaneously with elongate cylindrical shaft 33. Imprinting roller 19 is fixedly attached to and rotates simultaneously with elongate cylindrical shaft 34. Elongate cylindrical shafts 23, 24, 28, 29, 30, 33, 34 are parallel to one another, as are rollers 14 to 19, 21.

Plate 31 can be fabricated from metal, rubber, or any other desired material. Rollers 14 and 15 presently are of equal diameter and rotate at the same speed to facilitate construction of the gearing which drives rollers 14 and 15. If desired, the size and speed of rotation of roller 14 can be different than those of roller 15. Rollers 14 and 15 also presently rotate in opposite directions, as indicated by arrows A and B in FIG. 1. If desired, roller 14 can rotate in the same direction as roller 15. The direction of rotation of distributor roller 16 is indicated by arrow C in FIG. 1 and presently is opposed to the direction of rotation of roller 15. The velocity of a point on the surface of distributor roller 26 normally is greater than the velocity of a point on the surface of roller 15. Consequently, when strip 27 contacts surface 26, roller 16 imparts a force to strip 27 and to roller 15 which acts to increase the speed of rotation of roller 15 in the direction of arrow B. When rollers 14 and 15 are driven by a pulley or by a gear train, there normally is no slack in the gear train and the speed of rotation of roller 15 will not increase when strip 27 contacts surface 26 of a distributor roller 16 which has a surface speed greater than the speed of movement of strip 27. In this situation, strip 27 slides over surface 26. In the embodiment of the invention shown in FIG. 3, however, the drive for rollers 14 and 15 is provided with a one-way clutch which, when strip 27 contacts the surface 26 of roller 16, permits rollers 14 and 15 to free-wheel and move at a greater than normal speed while strip 27 contacts the surface 26 or roller 16. The functioning of this one-way clutch is further described below.

In FIG. 1, form rollers 17 and 18 comprise downstream rollers. Downstream rollers receive ink from the distributor roller 16 and carry the ink to a desired roller station. As used herein, downstream rollers can comprise vibrator rollers, form rollers, rider rollers or any other type of roller used in a chain of rollers to transfer ink from the distributor roller 16 to a desired station roller. There can be one or more downstream rollers. There typically are four or more downstream rollers. The station roller is any roller which receives ink from the downstream roller(s). In FIG. 1, the imprinting roller 19 is a station roller.

The distributor roller 16, imprinting roller 19, and support roller 21 presently preferably are driven rollers. Form rollers 17 and 18 can be driven. During the operation of the apparatus of FIG. 1, shafts 23, 24, 28, 29, 30, 33, 34 maintain the spacings relative to one another which are indicated in FIG. 1, i.e., the shafts do not move in horizontal or vertical directions which lie in the plane of the sheet of paper of the drawing of FIG. 1. As would be appreciated by those of skill in the art, if roller 17 was a vibrator roller, roller 17 would move back and forth in directions which are parallel to the longitudinal axis of shaft 29 and perpendicular to the plane of the sheet of paper of the drawings.

Figure 2:
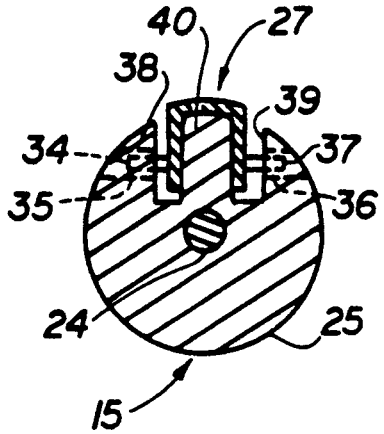
FIG. 2 is a section view illustrating a ductor roller constructed in accordance with the invention; and, FIG. 3 is a perspective view of the fountain roller and ductor roller of FIG. 1 illustrating a drive mechanism which can be employed in the practice of the invention.

In FIG. 2, elongate parallel slots 38 and 39 are formed in roller 15 and are parallel to the longitudinal axis of roller 15. The edges of strip 27 wrap around tongue 40 and extend into slots 38, 39. Externally threaded set screws 34, 37 are turned into internally threaded apertures formed in roller 15. Set screws 34, 37 press the edges of strip 27 against the walls of tongue 40. In addition to the method shown in FIG. 2, any other desired method and apparatus can be utilized to position strip 27 on roller 15 so a portion of strip 27 extends outwardly from cylindrical surface 25 to contact both surface 22 and surface 26 during the rotation of roller 15 in the direction of arrow B. Strip 27 is resilient. Fabricating strip 27 from a hard non-compressible material like steel is not recommended in the practice of the invention. Presently, strip 27 extends a distance outwardly from surface 25 which is about 0.002 inch greater than the distance between rollers 14 and 15 at their point of closest approach. Consequently, when strip 27 contacts surface 22, strip 27 just "kisses" and is slightly compressed by surface 22, and by surface 26 when strip 27 contacts surface 26.

Figure 3:
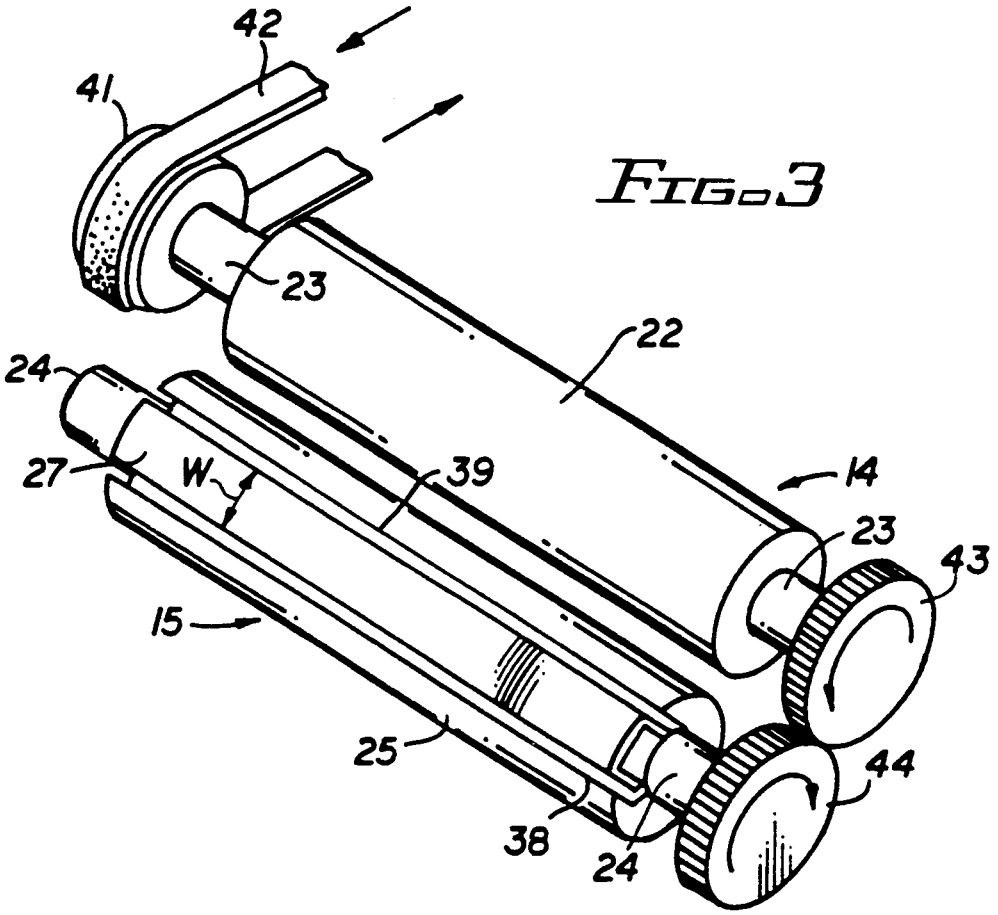

The fountain roller 14 and ductor roller 15 are illustrated in FIG. 3 with the fountain means and other rollers in FIG. 1 omitted for the sake of clarity. Belt 42 turns one-way clutch bearing assembly 41 connected to shaft 23 of roller 14. Toothed gear 43 is attached to shaft 23. Toothed gear 44 is attached to shaft 24 of roller 15. In operation, while roller 15 is rotating and strip 27 is not in contact with surface 26 of distributor roller 16, belt 42 turns one-way clutch bearing assembly 41 and roller 14 at the same rpm. Gear 43 turns gear 44 and roller 15 and causes rollers 15 and 14 to rotate at the same speed. When strip 27 contacts surface 22 of roller 14, rollers 14 and 15 continue to turn at about the same speed as the one-way clutch bearing assembly 41. When, however, strip 27 contacts surface 26 of roller 16 (not shown in FIG. 3), roller surface 26 is normally moving at a greater speed than strip 27 and surface 26 imparts a supplemental force to strip 27 which acts to increase the speed of rotation of roller 15 in the direction of arrow B. When this supplemental force is applied to strip 27, one-way clutch bearing assembly 41 permits the speed of rotation of rollers 14 and 15 to increase over the normal speed of rotation imparted by belt 42. As soon as strip 27 loses contact with surface 27, the speed of rotation of rollers 14 and 15 slows back to the normal speed of rotationimparted by belt 42. Clutch assembly 41 permits the speed of rotation of rollers 14 and 15 to be increased over the speed of rotation imparted by belt 42, but does not permit the speed of rotation to be decreased with respect to the speed of rotation imparted by belt 42. The use of one-way clutch bearing assembly 41 significantly improves the transfer of ink from strip 27 to surface 26 by enabling the speed of movement of strip 27 to temporarily be increased to match the speed of movement of the outer surface 26 of roller 16. If desired, a mechanism can be utilized in place of a one-way clutch 41 which allows the speed of strip 27 to be temporarily slowed by surface 26 when strip 27 contacts surface 26. The structure and operation of one-way clutch bearing assembly 41 is well known in the art and will not be described in detail herein. A manufacturer of one-way clutches of the type presently utilized in the invention is Torrington Company, 59 Field Street, Torrington, Conn. 06790.

Longitudinal strip 27 is presently preferably parallel to the longitudinal axis of roller 15, but can, if desired, be slightly canted with respect to the longitudinal axis of roller 15. When strip 27 is canted with respect to the longitudinal axis of roller 15, strip 27 is wound partially around roller 15 in a helical fashion. If desired, strip 15 can only extend partially across roller 15. As used herein, the term longitudinal strip includes a strip 27 parallel to the longitudinal axis of roller 15 and includes a strip which winds partially around roller 15 in helical fashion. In the practice of the invention, it is not contemplated that strip 27 continuously contact surface 22 or surface 26 sequentially contacts surface 22 and surface 27. Strip 27 contacts surface 22, loses contact with surface 22, then contacts surface 26, loses contact with surface 26, then contacts surface 22, etc.

In operation of the printing apparatus of FIGS. 1 to 3, fountain means 11 spread a film of ink on the outer cylindrical surface 22 as roller 14 rotates in the direction of arrow A. Gear 43 causes roller 15 to turn at the same speed as roller 14. Each time longitudinal strip 27 moves through the closest point of approach of rollers 14 and 15, strip 27 "kisses" surface 22 and receives ink therefrom. Each time strip 27 moves through the closest point of approach of rollers 15 and 16, strip 27 kisses and transfers ink to surface 26. Ink from surface 26 travels onto the outer cylindrical surfaces of form rollers 17 and 18 and from the outer cylindrical surfaces of form rollers 17 and 18 onto raised portions of the outer surface of plate 31. As plate 31 rotates, it transfers ink from the raised portions of plate 31 onto a strip 20 of paper or other material traveling intermediate rollers 19 and 21 in the directions of arrow D. The velocity of a point on surface 26 is greater than the velocity of strip 27. When strip 27 kisses surface 26, one-way clutch assembly 41 permits rollers 14 and 15 to free-wheel and increase their speed of rotation such that the speed of movement of strip 27 is subsequently equivalent to the speed of movement of surface 26. As soon as strip 27 loses contact with roller 16, the speed of rotation of rollers 14 and 15 slows to the speed produced when belt 42 turns roller 14.

The surfaces of rollers 14, 16, 17, 18, 21 generally comprise smooth cylindrical surfaces. Since surface 25 does not contact surface 22 or 26, surface 25 does not need to be cylindrical but can have any desired shape and dimension. Roller 15 preferably is shaped to maintain its balance while it rotates about the axis of shaft 24.

The width, W, of strip 27 can vary as desired, but presently is one-quarter to one-half inch wide.

At least rollers 14 and 15 are mounted in a portable housing which is detachable from the remainder of the printing press. Fountain means 11, roller 16, roller 17, roller 18, roller 19, and/or roller 21 can be mounted in the portable housing along with rollers 14 and 15. In the presently preferred embodiment of the invention, fountain means 11 and rollers 14 to 18 are mounted together in a portable housing. Shafts 23, 24, 28, 29, 30 are journalled for rotation in the housing.

While shafts 23, 24, 28, 29, 30, 33, 34 maintain the spacings relative to one another while the apparatus of FIG. 1 is operating, shafts 23 and 24 can be mounted on a frame which permits the fixed distance which roller 15 maintains from roller 14 during the operation of the apparatus of FIG. 1 to be adjusted while the machine is being set-up for operation. After the ductor roller 15 is adjusted to achieve the desired distance between rollers 14, 15, the position of the shaft 24 is fixed such that during operation of the apparatus of FIG. 1, the distance between rollers 14 and 15 is fixed and maintained. The position of the support frame in which the rollers 14, 15 are rotatably mounted, and in which shaft 24 is adjustably rotatably mounted in the manner just noted, can also be adjusted such that the fixed distances which rollers 14, 15 maintain from roller 16 during the operation of the apparatus of FIG. 1 can simultaneously be adjusted. Once the desired distances from rollers 14, 15 to roller 16 is achieved, the adjustable support frame carrying rollers 14, 15 is fixed in position such that the distance between rollers 15 and 16 and the distance between rollers 14 and 16 is maintained during operation of the apparatus of FIG. 1. The afore-described adjustability of roller 15 with respect to roller 14 and the adjustability of rollers 14 and 15 with respect to roller 16 can be achieved using prior art housing and gearing systems and such housing gearing systems will not be described herein. It is only important that in the practice of the invention such adjustable mounting of roller 15 and of rollers 14 and 15 in tandem during set-up of the apparatus further the practical use of the invention.

Having described my invention in such terms as to enable those skilled in the art to understand and practice it, and having identified the presently preferred embodiments thereof,

I claim:

1. An ink distribution assembly for printing apparatus, said assembly including (a) a fountain roller;

(b) fountain means for storing a quantity of ink and distributing the ink on said fountain roller;

(c) ductor roller means generally parallel to and at a fixed distance from said fountain roller and an outer surface spaced i) having an outer surface spaced apart from said fountain roller, (ii) including a longitudinal resilient strip extending outwardly from said outer surface, said strip intermittently contacting said fountain roller to receive ink from said fountain roller;

(d) a distributor roller generally parallel to and at a fixed distance from said ductor roller means, said strip intermittently contacting said distributor roller to transfer ink from said strip to said distributor roller;

(e) at least one downstream roller parallel to and operatively associated with said distributor roller to carry ink from said distributor roller to a selected roller station in said printing apparatus; and, (f) motive power means for driving said fountain roller, said ductor roller means, and said distributor roller, and including gearing means which, when said strip contacts said distributor roller and said distributor roller imparts a force to said strip which acts to increase the speed of rotation of said ductor roller means, disengages said ductor roller means and said fountain roller from said motive power means and permits the speed of rotation of said ductor roller means and said fountain roller to be increased while said strip contacts said distributor roller.

2. An ink distribution assembly for printing apparatus, said assembly including (a) a fountain roller;

(b) fountain means for storing a quantity of ink and distributing the ink on said fountain roller;

(c) ductor roller means generally parallel to and at a fixed distance from said fountain roller and (i) having an outer surface spaced apart from said fountain roller, and (ii) including a longitudinal resilient strip extending outwardly from said outer surface, said strip intermittently contacting said fountain roller to receive ink from said fountain roller;

(d) a distributor roller generally parallel to and at a fixed distance from said ductor roller means, said strip contacting said distributor roller once during each rotation of said ductor roller means to transfer ink from said strip to said distributor roller;

(e) a least one downstream roller parallel to and operatively associated with said distributor roller to carry ink from said distributor roller to a selected roller station in said printing apparatus; and, (f) motive power means for driving said fountain roller, said ductor roller means, and said distributor roller, and including gearing means which, when said strip contacts said distributor roller and said distributor roller imparts a force to said strip which acts to increase the speed of rotation of said ductor roller means, disengages said ductor roller means from said motive power means and permits the speed of rotation of said ductor roller means to be increased while said strip contacts said distributor roller.

3. An ink distribution assembly for printing apparatus, said assembly including (a) a fountain roller;

(b) fountain means for storing a quantity of ink and distributing the ink on said fountain roller;

(c) ductor roller means generally parallel to and at a fixed distance from said fountain roller and (i) having an outer surface spaced apart from said fountain roller, and (ii) including a longitudinal resilient strip extending outwardly from said outer surface, said strip intermittently contacting said fountain roller to receive ink from said fountain roller;

(d) a distributor roller generally parallel to and at a fixed distance from ductor roller means, said strip intermittently contacting said distributor roller to transfer ink from said strip to said distributor roller;

(e) at least one downstream roller parallel to and operatively associated with said distributor roller to carry ink from said distributor roller to a selected roller station in said printing apparatus; and, (f) means for rotating said fountain roller, said ductor roller means, said distributor roller.

4. The ink distribution assembly of claim 3 wherein said fountain roller, said fountain means, and said ductor roller means are in a portable frame detachable from said printing apparatus.

5. The ink distribution assembly of claim 3 wherein said fountain roller, said fountain means, said ductor roller means, said distributor roller, and said downstream roller are mounted in a portable frame detachable from said printing apparatus.

6. The ink distribution assembly of claim 3 wherein said fountain roller, said fountain means, said ductor roller means, and said distributor roller are mounted in a portable frame detachable from said printing apparatus.

7. The ink distribution assembly of claim 2 wherein said fountain roller, said fountain means, and said ductor roller means are mounted in a portable frame detachable from said printing apparatus.

8. The ink distribution assembly of claim 2 wherein said fountain roller, said fountain means, said ductor roller means, said distributor roller and said downstream roller are mounted in a portable frame detachable from said printing apparatus.

9. The ink distribution assembly of claim 2 wherein said fountain roller, said fountain means, said ductor roller means, and said distributor roller are mounted in a portable frame detachable from said printing apparatus.

10. The ink distribution assembly of claim 1 wherein said fountain roller, said fountain means and said ductor roller means are mounted in a portable frame detachable from said printing apparatus.

11. The ink distribution assembly of claim 1 wherein said fountain roller, said fountain means, said ductor roller means, said distributor roller, and said downstream roller are mounted in a portable frame detachable from said printing apparatus.

12. The ink distribution assembly of claim 1 wherein said fountain roller, said means said ductor roller means, and said distributor roller are mounted in a portable frame detachable from said printing apparatus.

13. The ink distribution assembly of claim 10 wherein said portable frame includes means for adjusting said fixed distance of said ductor roller from said fountain roller.

14. The ink distribution assembly of claim 13 including means for adjusting said portable frame to adjust simultaneously the distance of said fountain roller and said ductor roller from said distributor roller.

* * * * *